US008992176B2

(12) United States Patent
Haseman et al.

(10) Patent No.: US 8,992,176 B2
(45) Date of Patent: Mar. 31, 2015

(54) DETACHABLE DEBRIS REMOVAL APPARATUS

(76) Inventors: Terry L Haseman, Lake Villa, IL (US); Donald J Silvert, Northbrook, IL (US); Daniel C Pierron, Melbourne, FL (US)

( * ) Notice: Subject to any disclaimer, the term of this patent is extended or adjusted under 35 U.S.C. 154(b) by 728 days.

(21) Appl. No.: 13/241,147

(22) Filed: Sep. 22, 2011

(65) Prior Publication Data

US 2012/0107097 A1 May 3, 2012

Related U.S. Application Data

(60) Provisional application No. 61/385,189, filed on Sep. 22, 2010.

(51) Int. Cl.
*A01B 1/22* (2006.01)
*F04D 25/08* (2006.01)

(52) U.S. Cl.
CPC ..... *F04D 25/084* (2013.01)
USPC ..... 415/220; 294/59

(58) Field of Classification Search
USPC ..... 294/59, 51, 55.5, 57; 15/405, 404, 15/327.5, 344, 419; 56/400.04, 400.08; 415/220
See application file for complete search history.

(56) References Cited

U.S. PATENT DOCUMENTS 3,999,243 A * 12/1976 La Pour ..... 15/344
5,257,913 A * 11/1993 Schwarzer et al. ..... 417/411
5,332,222 A * 7/1994 Perry ..... 473/300
5,407,135 A * 4/1995 Jeffs ..... 239/288
5,938,410 A * 8/1999 Lee ..... 417/234
6,039,062 A * 3/2000 Karakaedos ..... 135/16
6,053,968 A * 4/2000 Miller ..... 96/224
6,092,260 A * 7/2000 Kai ..... 15/320
7,510,225 B1 * 3/2009 Stinnett et al. ..... 294/59
7,845,048 B1 * 12/2010 Bailey et al. ..... 15/405
2004/0221882 A1 * 11/2004 Watson et al. ..... 135/16
2006/0090290 A1 * 5/2006 Lau ..... 15/344
2007/0045364 A1 * 3/2007 Grundy et al. ..... 224/197

* cited by examiner

*Primary Examiner* — Edward Look
*Assistant Examiner* — Aaron R Eastman
(74) *Attorney, Agent, or Firm* — Silvert IP Law, P.C.; Donald J. Silvert

(57) ABSTRACT

A detachable portable debris removal apparatus designed to attach to a shaft, such as a golf club. The apparatus includes a housing having an internal cavity containing a motor, a fan, and a power supply to operate said motor, turning the fan. The apparatus further includes a control switch to selectively turn the apparatus on and off. Two openings in the housing permit a flow of air through the internal cavity when the motor is operated. The apparatus further includes an attachment member configured to attach to a shaft. The attachment member can be integrated into the housing or attached to an outside surface of the housing. The apparatus can further include a collection assembly disposed within the internal cavity to collect debris drawn into the housing. The collection assembly can be optionally removable from the internal cavity, permitting the apparatus to function optionally as a blower or a vacuum.

21 Claims, 4 Drawing Sheets

DETACHABLE DEBRIS REMOVAL APPARATUS

The present application claims priority from U.S. Provisional Application Ser. No. 61/385,189, filed Sep. 22, 2010, which is hereby incorporated in its entirety herein.

BACKGROUND OF THE INVENTION

When golfing, it is common for the putting green to contain leaves, dirt, and other debris. It is ideal to putt from a clear green to ensure that the ball is not deflected by the debris. Many golfers attempt to clear the putting surface themselves using their shoes or their clubs. This can be a time consuming and frustrating process. A more efficient method is needed.

A variety of attempts to solve this problem have been made. Some solutions were simply a brush that had been permanently integrated with a golf club handle. This solution represented an improvement over using one's foot, but still required significant effort on the part of the user to clear substantially long paths, if so required.

Further solutions have included transportable stand-alone blowers. However, these solutions require long conduits for the air, making the solution unwieldy and take up more space either in the golf bag of the user or elsewhere, in an activity where storage space is at a premium.

Yet further solutions have included permanently integrating blowers with common golfing paraphernalia, such as golf clubs and umbrellas. However, such integrations have a number of undesirable consequences. First, the weight of the blower can render the original article cumbersome and unmanageable for its original intended purpose. This is true for both umbrellas and golf clubs, the latter of which is particularly impacted by issues of balance and weight. Second, the configuration of the original article to integrate the blower can also have deleterious effects. In the instance of a putter, the presence of tubing at the head of the club, or integrated into the head itself, can reduce the effectiveness of the club for putting in a variety of ways, including unfavorable weight distributions, reduced stiffness, etc. As such, integration of a blower with a golfing article presents the user with the undesirable result of using a less-than-adequate golf club or carrying a standard club in addition to the club integrated with the blower.

Therefore, there exists a need for solution to moving debris from a putting green that meets the needs of portability and efficiency without undesirable effects such as occupying too much space or diminishing the performance of the attached golfing article.

SUMMARY OF THE INVENTION

In view of the foregoing background, it is one object of the invention to provide a detachable portable blower for removing debris from a putting green.

In one aspect of the invention, the invention comprises a housing surrounding a motor, a fan operably coupled to the motor, and a power supply electrically coupled to the motor. The housing comprises a first opening on one surface and a second opening on another surface. The housing further comprises an interior cavity configured to accommodate the above motor and fan as well as permit air flow from the first opening to the fan and from the fan to the second opening. The housing further comprises a control switch for starting the invention, such as a spring-loaded on/off button or switch. Finally, the housing is configured to detachably couple with a golf club.

DETAILED DESCRIPTION OF THE PREFERRED EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Throughout the figures, like numbers refer to like elements.

In the following description, spatial orientation descriptors "distal" and "proximal" are used relative to the longitudinal axis of the catheter assembly. Thus, a "proximal" side refers to a side of an element generally facing the user and away from the putting green and, conversely, a "distal" side refers to a side of an element generally facing away from the user and toward the putting green. Likewise a pair of elements described as "proximal" and "distal" elements are understood to have the same spatial relationship as described hereinabove for the sides of an element.

Figure 1:
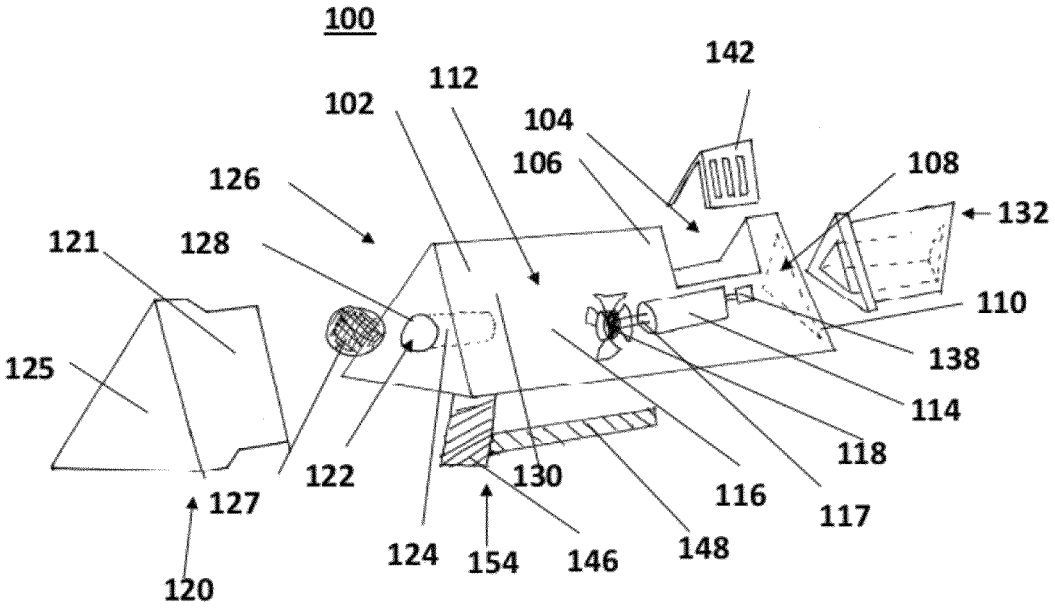
FIG. 1 is an exploded perspective view of an embodiment of the invention.

One embodiment of the invention is depicted in FIG. 1. The debris removal apparatus 100 includes a housing 102 having a first opening 104 on at least a first surface 106 and a second opening 108 on at least a second surface 110. The first surface 106 and the second surface 110 are optionally the same surface or different surfaces as employed in different embodiments of the present invention. The housing further comprises an interior cavity 112 that is in fluid communication with the first opening 104 and the second opening 108.

The debris removal apparatus 100 can further comprise a motor 114. The motor can be any type of motor, such as an electric motor; in one embodiment, the motor is an electric motor having a design that is suitable for use in a portable vacuum or blower, as is known generally in the art. The motor 114 is disposed within the interior cavity 112 and fixedly attached to an inside surface 116 of the housing 102 by any suitable means, such as by screw, weld, staple, adhesive, nut-and-bolt, or any other fastener.

The debris removal apparatus 100 further comprises a means for transferring air, such as a fan 118. The fan 118 is configured to be coupled operably to the motor 114. For example, the fan can be fixedly attached to an axle 117 that is driven by the motor 114. When in operation, the fan 118 creates a flow of air such that a negative pressure is created at one of the first opening 104 and the second opening 108 and a corresponding positive pressure is created at the other of the first opening 104 and the second opening 108, thereby creating a flow of air between the first opening 104 and the second opening 108.

In the embodiment shown in FIG. 1, the housing 102 further comprises an attachment member 122. The attachment member 122 is configured to attach removably the debris removal apparatus 100 to a shaft, for example, a golf club handle or a broom. In the embodiment depicted in FIG. 1, the attachment member 122 comprises a tubular receiving section 124 formed in a proximal section 126 of the housing 102. The tubular receiving section 124 is configured to accommodate a shaft therein. Optionally, the tubular receiving section 124 includes a taper, narrowing from the proximal end 128 of the tubular receiving section 124 to the distal end 130 of the tubular receiving section 124. The tapering of the tubular receiving section 124 creates an interference fit between the shaft and the tubular receiving section 124, removably attaching the housing 102 to the shaft.

In yet another embodiment, the tubular receiving section 124 is cylindrical and without a taper. An interference fit between the tubular receiving section 124 and the shaft is accomplished by the shaft having a taper, the taper of the shaft causing the shaft to interface with the tubular receiving section 124.

The debris removal apparatus 100 as shown in FIG. 1 further comprises a mesh 127 disposed at the distal end 130 of the tubular receiving section 124, serving as a protective barrier between the shaft and the distal end 130.

The debris removal apparatus 100 further comprises a power supply 119. In the instant embodiment shown in FIG. 1, the power supply 119 includes a plurality of batteries. The plurality of batteries can include two, three, four, five, or about six standard sized 1.5 V batteries, such as, for example, AA, B, C, or D batteries as known in the art. Other power supplies that may alternatively be used in the context of the present invention include other sources or storage units of electric energy that are capable of delivering a sufficient flow of energy to drive the motor, including, for example, a single battery, one or more rechargeable batteries, and external power supplies, such as an electrical connection to an external source of power. The power supply 119 is coupled electrically to the motor 114 and provides the electromotive force to drive the motor 114 that in turn drives the air transferring means, i.e., a fan, for example.

The power supply 119 can be positioned in a variety of locations. In the present embodiment, the debris removal apparatus 100 further comprises a power supply housing 120. The power supply housing 120 is configured to attach to the housing 102. In the present embodiment, the power supply housing 120 comprises a distal attachment section 121 configured to reside within the internal cavity 112 and attach removably to the housing 102. The power supply housing 120 further comprises a proximal section 125 that resides outside the housing 102. In the embodiment displayed in FIG. 1, the power supply 119 is disposed within the power supply housing 120. The power supply housing 120 is configured to couple electrically the power supply 119 to the motor 114. For example, the power supply housing 120 can comprise a plurality of electrical contacts in electrical communication with the power supply 119, and the housing 102 can similarly comprise a plurality of electrical contacts in electrical communication with the motor. When the power supply housing 120 attaches to the housing 102, each of the electrical contacts of the power supply housing 120 communicates with a corresponding electrical contact on the housing 102.

As shown FIG. 1, the power supply housing 120 is adjacent to the attachment member 122 of the housing. In order to allow attachment of the housing 102 to the shaft, the power supply housing 120 further comprises a central axis channel 130 (not shown) located along a substantially central axis of the power supply housing 120. In one embodiment, the central axis channel 130 is configured to permit the shaft to pass therethrough and extend to the attachment member 122.

Figure 2:
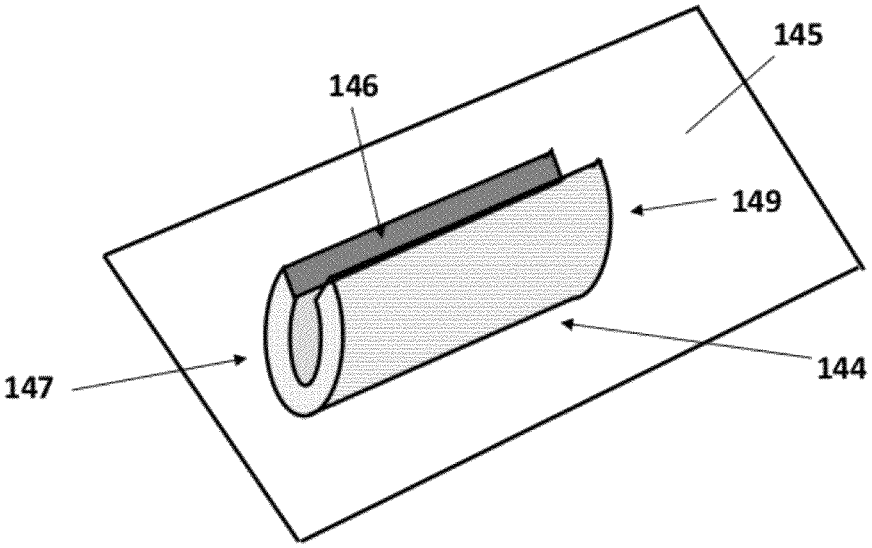
FIG. 2 is a perspective view of one embodiment of the attachment member the invention.

In another embodiment, as depicted in FIG. 2, the attachment member 122 comprises a hollow horizontal cylindrical segment 144 configured to accommodate the shaft, having an open edge 146. In this embodiment, the attachment member 122 is attached to an outside surface 145 of the housing 102 such that the open edge 146 is directed generally radially outward from the housing 102. In one embodiment, the attachment member 122 defines a longitudinal axis parallel to the longitudinal axis of the housing 102. The shaft is then inserted into the attachment member 122 by translating the shaft radially inwards into the attachment member 122 through the open edge 146 forming an interference fit with the attachment member 122. The housing 102 is detached from the shaft by translating the shaft either longitudinally out the proximal end 147 or the distal end 149 of the hollow horizontal cylindrical segment 144 or translating the shaft radially outward through the open end 146.

Figure 3:
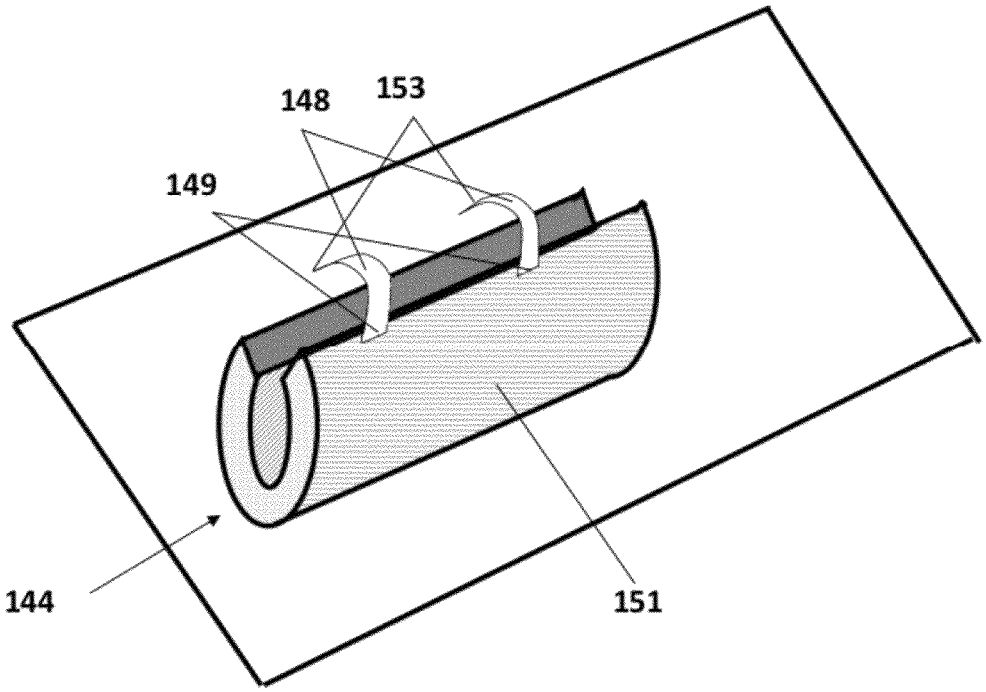
FIG. 3 is a perspective view of another embodiment of the attachment member.

In a further embodiment, depicted in FIG. 3, the attachment member 122 comprises a hollow horizontal cylindrical segment 144 as above, and further comprises one or more attachment straps 148 permanently attached at a first end 149 to the outside surface 151 of the hollow horizontal cylindrical segment 144. When the shaft is disposed within the attachment member 122, the attachment straps 148 transverse the open edge 146 and attach removably to the outside surface 151 of the hollow horizontal cylindrical segment 144 at a second end 153. Suitable methods of removable attachment employed in the context of the present invention include snaps, hook-and-loop, buckles, clasps, eye-and-hook, and magnets, among others. The second end 153 of the attachment straps 148 are detached from the outside surface 151 of the hollow horizontal cylindrical segment 144, permitting removal of the shaft from the attachment member 122 and detachment of the housing 102 from the shaft.

Figure 4:
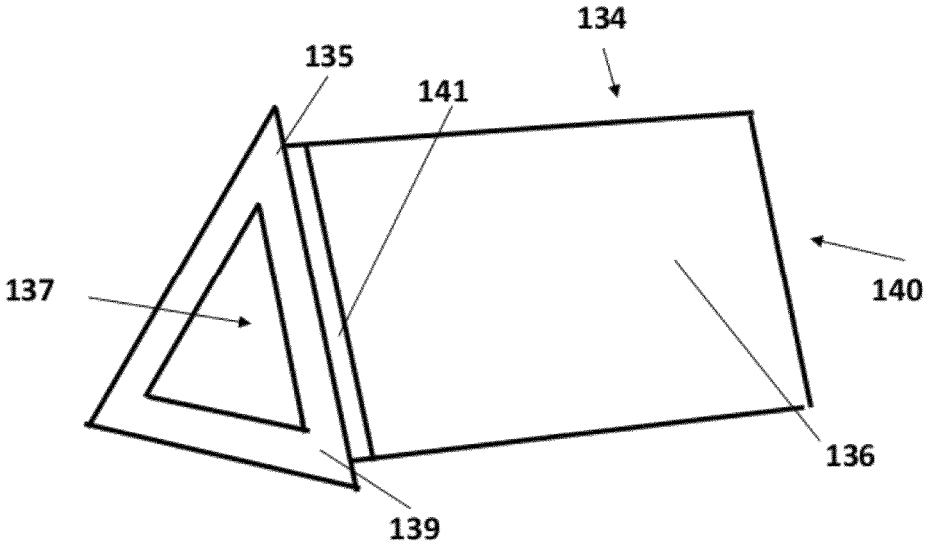
FIG. 4 is an exploded view of the control switch.

The debris removal apparatus 100 further comprises a control switch, an embodiment of which is depicted in FIG. 4 as element 132. The control switch 132 is configured to selectively open and close the electrical circuit between the power supply 119 and the motor 114. In the present embodiment, the control switch 132 takes the form of a spring-loaded switch 134 disposed at the distal end of the housing. The spring-loaded switch 134 comprises an attachment section 135 and a nozzle member 136. The attachment section 135 attaches the spring-loaded switch 134 to the housing 102 at the second opening 108. Both the attachment section 135 and the nozzle member 136 are configured to permit fluid flow from the second opening 108 through the attachment section 135 and the nozzle member 136, such as by forming a conduit 137. In the current embodiment, the second opening 108, the attachment section 135, and the nozzle member 136 form a conduit 137 having a generally triangular configuration. Other configurations included in the invention are circles, squares, rectangles, and all other polygons—in essence, any transverse shape so long as sufficient area is provided that allows a sufficient amount and rate of airflow.

As shown in FIG. 4, the nozzle member 136 is attached to the attachment section 135 so as to allow the nozzle member 136 to translate longitudinally with respect to the attachment section 135. In the present embodiment, the attachment member 135 is comprised of a proximal attachment section 139 and a distal flap 141. The proximal attachment section 139 attaches to the housing 102 at the second opening 108 by any suitable method, such as by welding, soldering, adhesives, tapes, glues, snaps, screws, staples, or any other fasteners.

The distal flap 141 is configured to bend, overlapping with itself and the proximal attachment section 137, so as to permit the nozzle member 136, to which the distal flap 141 is attached, to translate proximally with respect to the proximal attachment section 139. Accordingly, the distal flap 141 is composed of a flexible material, such as rubber or a suitable synthetic that emulates the properties of rubber. The distal flap 141 is attached to the nozzle member 136 by any suitable means, including adhesives, tape, glue, or any other fasteners.

When the nozzle member 136 translates proximally, it interfaces with an activation member 138 (See FIG. 1) of the motor 114 that, when translated proximally, closes the electric circuit between the motor 114 and the power supply 119, causing the motor 114 to operate. When released, the nozzle member 136 will return to its original orientation with respect to the attachment member 135, and the flow of air from the fan 118 will be directed through the second opening 108, through the conduit 137, and out the distal end 140 of the nozzle member 136. When the nozzle member 136 is translated longitudinally again, it will again interface with the activation member 138 of the motor 114, this time opening the circuit between the motor 114 and the fan 118, terminating the operation of the motor 114. When released, the nozzle member 136 will return to its original orientation with respect to the attachment section 135.

The control switch 132 of the present embodiment is an example only and does not limit the scope of switches included in the invention. Other types of switches include toggle switches, knob switches, push-buttons, slide switches, and throw switches, and the like.

The debris removal apparatus 100 further comprises a slotted cover 142 configured to attach to the housing 102 so as to cover the first opening 104. The slotted cover 142 protects against foreign debris entering the internal cavity 112 of the housing, potentially damaging the motor 114, the fan 118, the power supply 119, or any other part of the debris removal apparatus 100, while still permitting fluid flow through the first opening 104.

As depicted in FIG. 1, the debris removal apparatus 100 further comprises a clip 154 configured to attach the housing 102 removably to an external body, such as a golf bag. The clip 154, in one embodiment, comprises a radially extending body member 146 that attaches to an outside surface of the housing 102. The method of attachment is by any suitable joining means include welding, adhesives, screws, hook-and-loop, rivets, snaps, or any other fastening apparatus or method. The clip 154 can further comprise a longitudinally extending arm 148 configured to project from the radially extending body member 146 in a generally longitudinal direction with respect to the housing 102. The longitudinally extending arm 148 is configured to be spaced a distance radially apart from an outside surface of the housing 102 to accommodate an external body there between. In use, the external body is disposed between the longitudinally extending arm 148 and the outside surface of the housing 102 and abuts the radially extending body member 146.

The housing 102, power supply housing 120, slotted cover 142, nozzle member 136, and clip 154 are fabricated from any material appropriate to accomplish the above requirements. Such materials include synthetic polymers such as polypropylene, melamine formaldehyde, polyurethane, and acrylonitrile-butadiene-styrene. Other materials include metals, such as stainless steel. If a metal is used, the metal can optionally be coated with a polymer.

Figure 5A:
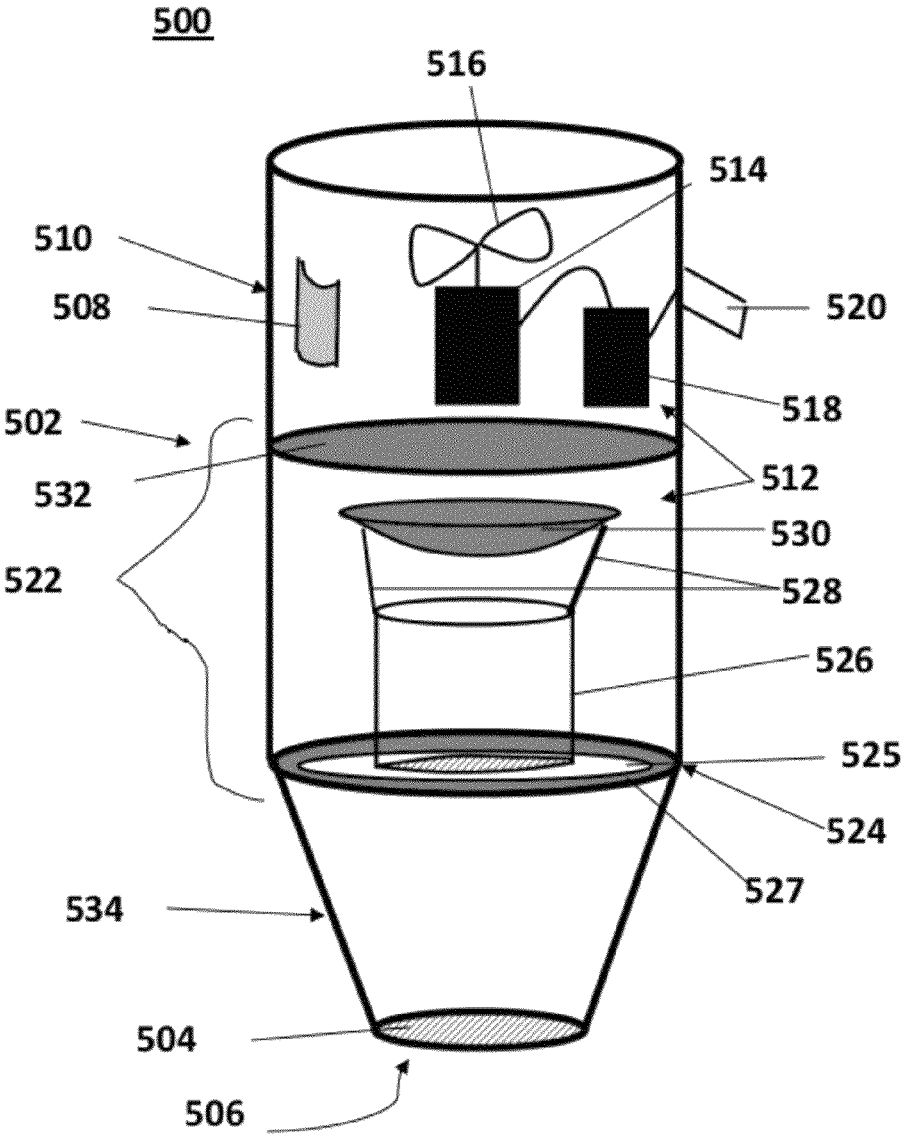
FIG. 5A is a sectional view of an embodiment of the invention.

In an alternative embodiment, depicted in FIG. 5A, the debris removal apparatus 500 comprises a housing 502 having a first opening 504 on at least a first surface 506, a second opening 508 on at least a second surface 510, and an internal cavity 512, a motor 514, a fan 516, a power supply 518, and a control switch 520. In another alternative embodiment, the debris removal apparatus 500 further comprises a collection assembly 522 comprising an annular receptacle 524, a central column 526, one or more deflector supports 528, a deflector 530, and a filter 532.

The collection assembly 522 is disposed within the internal cavity 512 between the distal end of the housing 502 and the motor 514, the fan 516, the power supply 518, and the second opening 508. The collection assembly 522 attaches to the inside surface of the internal cavity 512 so as to form a fluid barrier, preventing the flow of air through the internal cavity 512 except for through the collection assembly 522. The annular receptacle 524 comprises a generally flat plate 525, a lip 527 about an outside perimeter of the plate 525, and a void at about the center of the plate 525. The lip 527 attaches to the inside surface 513 of the internal cavity 512, thereby attaching the collection assembly 522 to the housing 502. The central column 526 attaches to the plate 525 and is disposed about the void of the plate 525. The method of attachment can be any suitable method, including welding, soldering, and adhesives. Alternatively, the central column 526 and the plate 525 can be a single integral piece.

The deflector 530 of the collection assembly 522 is configured to deflect particulates in the air flow coming through the central column 526. In the present embodiment, this is accomplished by disposing the deflector 530 at a location proximal the central column 526 along a longitudinal axis defined by the central column 526. In order to maintain this position, one or more deflector supports 528 are used. The deflector supports 528 are attached at a first end 534 to a point on the deflector 526 and at a second end to a point on the central column 526, such as the proximal end 536. The attachment of the deflector supports 528 to the deflector 530 and the central column 526 bear the weight of the deflector 530 as well as maintain the position of the deflector 530 when the fan 516 is operated, creating a variable pressure within the internal cavity 512. The method of attachment of the deflector supports 528 is any suitable method, including welding, soldering, adhesives, and optionally forming two or more of the deflector supports 528, the deflector 530, and the central column 526 as a single integral piece.

The filter 532 of the collection assembly 522 is generally located proximally of the deflector 530. The filter 532 is configured to form a gas-permeable barrier between the distal and proximal ends of the internal cavity 512, preventing the flow of particulates into the proximal end of the internal cavity 512. One such configuration is to attach the perimeter of the filter 532 to a circumferential section of the internal cavity 512 by a suitable attachment method, thereby permitting air flow to the proximal end of the internal cavity 512 only through the filter 532. The filter 512 may be fabricated of any suitable material, including wire mesh, foam, paper, and cotton.

The debris removal apparatus 500 is configured to create a negative pressure at the first opening 504, which is located at the distal end of the housing 502, and a positive pressure at the second opening 508, which is located towards the proximal end of the housing 502. This pressure system is created by configuring the fan 516 to create a flow of air exiting the internal cavity 512 at the second opening 508. In order to increase the negative pressure at the first opening 504, the housing 502 may further comprise a tapered section 534 on the distal side of the housing 502, with the first opening 504 defining the distal end of the tapered section 534. Reducing the size of first opening 504 with respect to the second opening 508 will increase the negative pressure at the first opening 504.

In operation, the control switch 520 in the closed position completes the circuit between the power supply 518 and the motor 514, causing the fan 516 to turn. The fan 516 then creates a positive pressure at the second opening 508, causing a flow of air out through the second opening 508. A corresponding negative pressure will be created at the first opening 504, drawing in air and particulate matter from the environment. The flow of air from the first opening will travel proximally through the tapered section 534 into the central column 526 and collide with the deflector 530. Particulate matter will bounce off the deflector 530, exit the flow of air, and fall to the plate 524 of the annular receptacle 522. The air flow will continue to travel proximally around the deflector, through the filter 532, and up to the second opening 508. The filter 532 will prevent particulate matter that is not deflected to the plate 524 by the deflector 530 from damaging the motor 514, the fan 516, or the power supply 518.

Figure 5B:
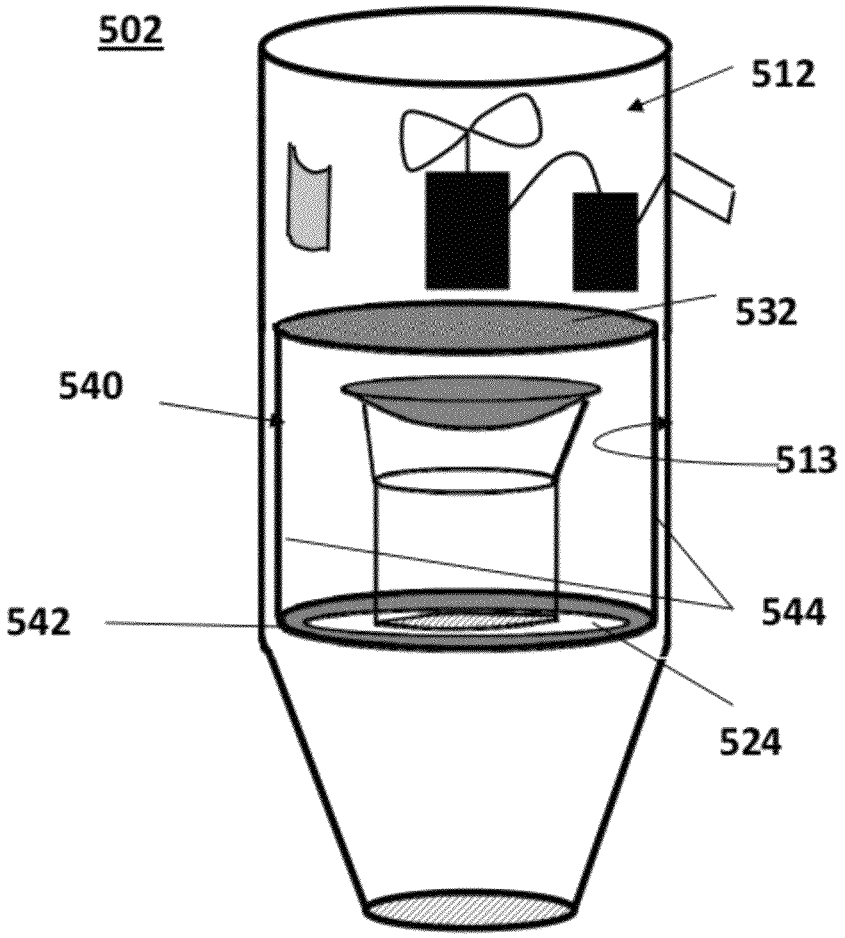
FIG. 5B is a sectional view of a further embodiment of the invention.

In an alternative embodiment, the collection assembly 522 depicted in FIG. 5A is reconfigured to be contained within a collection housing 540 as depicted in FIG. 5B. The collection housing 540 as shown for one embodiment comprises a base 542 defined by a distal surface of the annular receptacle 524, wall surfaces 544 dimensioned to be disposed within the internal cavity 512 of the housing 502, and a top surface defined by the filter 532. In some embodiments, the filter 532 is fixed in place, in which case the collection housing 540 is itself disposable and thus replaceable with a replacement such unit. In other embodiments, the filter 532 is itself removable and replaceable, which would elongate the usable life of the collection housing 540.

The housing in some embodiments further comprises a closable hatch (not shown) for allowing the placement and removal of the collection housing 540 in the internal cavity 512. When disposed within the internal cavity 512, the collection housing 540 forms an interference fit with the inside surface 513 of the internal cavity 512, thereby preventing fluid flow through the internal cavity 512 except through the collection housing 540, which performs identically to the collection assembly 522 described hereinabove. In yet further embodiments, the connection of the collection housing 540 at its base 542 to the housing 502 is achieved using a suitable attachment means that holds the collection housing 540 in place. Suitable attachment means has the ability to hold the collection housing 540 in place while being jostled from being attached to a golf bag while being carried or driven about a golf course, for example, or placed on the handle of a golf club or broom stick. Suitable attachment means include, without limitation intended, a weak adhesive, a high temperature melting grease, paired strips of hooks and eyes, as in a VELCRO® brand hook and loop fabric product, and the like.

Furthermore, in this embodiment, the motor 514 is configured to operate in a bi-directional capacity; that is, when the polarity of the DC circuit connected to the motor 514 is reversed, the direction of operation of the motor 514 is similarly reversed, thereby turning the fan 516 in the opposite direction and reversing the flow of air through the internal cavity 512. Such a reversal in polarity is enabled by configuring the control switch 520 to have settings for both directional operations of the motor 514, such as, for example, "forward" and "reverse," or "vacuum" and "blower." This is accomplished using the same types of switches described hereinabove. In one embodiment of the present invention, as one example, the control switch 520 is a three-position toggle switch that is configured, for example, with the off position centrally located between either of the aforementioned pairs of labeled switch positions. To maximize the positive pressure created at the first opening 504, it is preferable to remove the collection housing 540 from the inside cavity 512, however the overall design does not require doing so such that the collection housing 540 can be fixed within the housing 502. One further alternative embodiment of the present invention has the filter 532 removably inserted into receiving slots or slides (not shown) on the inside of the housing 502, allowing the collection housing 540 to fill with particulates when used in the vacuum mode in the annular space defined by the outside of the central column 526 and the inside wall 544. When full, the collection housing 540 is removed from the housing 502, allowing the user to dispose of the collected debris, then replace the collection housing 540 into the housing 502, thereby readying the detachable debris removal apparatus to be used to clear another putting path, as one exemplar use of the present invention.

While the invention has been described with respect to certain specific embodiments, it will be appreciated that many modifications and changes may be made by those skilled in the art without departing from the spirit of the invention.

What is claimed is:

1. A detachable debris removal apparatus comprising:

a motor;

a fan coupled operably to the motor;

a power supply coupled electrically to the motor;

a control switch; and a housing comprising a first opening on a first surface, a second opening on a second surface, an interior cavity in fluid communication with both the first opening and the second opening, and an attachment member configured to form a detachable interference fit between said attachment member and a shaft;

wherein the motor and fan are disposed within the internal cavity of the housing, and the fan is configured to direct a flow of air through the second opening; and wherein the switch is located proximal to the second opening.

2. The apparatus of claim 1, wherein the second surface is located on a distal surface of the housing, and the attachment member is located at a proximal end of the housing.

3. The apparatus of claim 1, further comprising a slotted cover member configured to attach to the housing so as to cover the first opening.

4. The apparatus of claim 1, wherein the control switch comprises a spring loaded switch.

5. The apparatus of claim 4, the control switch comprising a nozzle member and an attachment section, wherein the nozzle member and the attachment section define a conduit, the attachment section is configured to attach to the housing member thereby placing the conduit in fluid communication with the second opening.

6. The apparatus of claim 5, wherein the control switch is configured to actuate the motor when the nozzle member is translated proximally along the longitudinal axis of the housing.

7. The apparatus of claim 1, wherein the power supply comprises one or more batteries.

8. The apparatus of claim 1, where the attachment member comprises a tubular receiving section dimensioned to receive and engage with a shaft.

9. The apparatus of claim 8, wherein the tubular receiving section comprises a distally narrowing taper.

10. The apparatus of claim 1, wherein the attachment member comprises a hollow horizontal cylindrical segment configured to removably engage with a shaft and is attached to an outside surface of the housing.

11. The apparatus of claim 10, wherein the hollow horizontal cylindrical segment further comprises an open edge that is directed generally radially outward from the housing.

12. The apparatus of claim 11, further comprising one or more attachment straps having a first end and a second end, the first end being fixedly attached to an outside surface of the hollow horizontal cylindrical segment, the second end comprising an attaching member, and being configured to transverse the open edge and removably attach to an outside surface of the hollow horizontal cylindrical segment, wherein the hollow horizontal cylindrical segment comprises receiving members configured to removably attach to the attaching members of the attachment straps.

13. The apparatus of claim 1, wherein the housing further comprises a clip comprising a radially extending body member attached to a surface of the housing and a longitudinally extending arm attached to the radially extending body member, wherein the longitudinally extending arm is spaced radially apart from the housing.

14. A detachable debris removal apparatus comprising:

a motor;

a fan configured to couple operably to the motor;

a control switch;

a power supply housing comprising a power supply compartment and a central axis channel;

a power supply disposed within the power supply compartment of the power supply housing, wherein the power supply is configured to couple electrically to the motor; and a housing comprising a first opening on a first surface, a second opening on a second surface, an interior cavity in fluid communication with both the first opening and the second opening, and an attachment member configured to couple removably with a shaft;

wherein the motor and fan are disposed within the internal cavity of the housing, the fan is configured to direct a flow of air through the second opening, and the attachment member is disposed within the housing.

15. The apparatus of claim 14, wherein the power supply housing comprises a plurality of electrical contacts, the housing comprises a plurality of electrical contacts, and each electrical contact of the power supply housing is associated with and configured to electrically couple to an electrical contact on the housing.

16. The apparatus of claim 14, wherein the attachment member comprises a tubular receiving section, the tubular receiving member defines a longitudinal axis that is substantially collinear to the central axis channel of the power supply housing.

17. The apparatus of claim 16, further comprising a mesh disposed within the tubular receiving section of the attachment member.

18. The apparatus of claim 14, the housing further comprising: a collection assembly comprising an annular receptacle, a central column, one or more support members, a deflection member, and a filter, wherein the annular receptacle comprises a cylindrical space having a filter at its proximal end and a plate at its distal end, the central column extends proximally from the plate, the annular receptacle attaches to an inside surface of the housing, the one or more support members attach to a proximal end of the central column and extend generally proximally, and the deflection member is attached to a proximal end of the support members, and the filter is configured to create a gas-permeable barrier between the collection assembly and the fan and motor; wherein the first surface is located distally from the annular receptacle.

19. The apparatus of claim 18, the housing further comprising a taper at the distal section of the housing, wherein the first opening is located at the distal end, and the second opening is located proximally from the filter.

20. The apparatus of claim 18, further comprising a removable collection housing in which the collection assembly is disposed, wherein the housing further comprises a closable hatch configured to permit the collection housing to pass therethrough, and wherein the direction of operation of the motor is controlled by the polarity of the electric coupling between the motor and the power supply, and the control switch comprises settings to enable both directions of operations of the motor.

21. A detachable debris removal apparatus comprising;

a motor;

a fan coupled operably to the motor;

a power supply coupled electrically to the motor;

a polarity changing control switch;

a removable collection assembly;

a housing comprising a first opening on a first surface, a second opening on a second surface, an interior cavity in fluid communication with both the first opening and the second opening, and an attachment member configured to form a detachable interference fit between said attachment member and a shaft;

wherein the motor, fan, and removable collection assembly are disposed within the internal cavity of the housing, the fan is configured to direct a flow of air through the first opening or the second opening, and the polarity changing control switch has positions for forward and reverse; and wherein the polarity changing control switch is located proximal to the second opening.

* * * * *